United States Patent [19]

McCabe

[11] 4,372,342

[45] Feb. 8, 1983

[54] BALANCING DAMPER WITH QUICK SET ADJUSTMENT BRACKET

[76] Inventor: Francis J. McCabe, 239 Hastings Ct., Doylestown, Pa. 18901

[21] Appl. No.: 182,506

[22] Filed: Aug. 29, 1980

[51] Int. Cl.[3] ..... F16K 13/00

[52] U.S. Cl. ..... 137/601; 126/295; 251/112; 251/292

[58] Field of Search ..... 98/121 A; 137/601; 126/295; 251/112, 292

[56] References Cited

U.S. PATENT DOCUMENTS

| | | | |
|---|---|---|---|
| 1,210,390 | 1/1917 | Alsfasser | 126/295 |
| 1,368,453 | 2/1921 | Ream | 49/80 |
| 1,411,745 | 4/1922 | Rosenberg | 126/295 X |
| 2,130,476 | 9/1938 | Young | 126/295 |
| 2,217,479 | 10/1940 | Guyer | 251/112 X |
| 2,581,321 | 1/1952 | Fletcher | 189/62 |
| 2,702,504 | 2/1955 | Guildford | 126/295 X |
| 3,009,473 | 11/1961 | Hennen | 137/315 |
| 3,176,715 | 4/1965 | McQuown | 137/601 |
| 3,281,113 | 10/1966 | Ahern | 137/601 X |
| 3,381,601 | 5/1968 | McCabe | 98/121 |
| 3,426,507 | 2/1969 | Kossowski et al. | 55/129 |
| 3,592,240 | 7/1971 | Hedrick | 137/316 |
| 3,606,245 | 9/1971 | Reichow | 137/601 X |
| 3,664,372 | 5/1972 | Marshall | 251/292 X |
| 3,665,996 | 5/1972 | Roberts | 160/1 |
| 3,771,559 | 11/1973 | Alley | 137/601 |
| 3,960,065 | 6/1976 | McCabe | 98/40 D |
| 3,977,456 | 8/1976 | McCabe | 160/1 |
| 4,080,978 | 3/1978 | McCabe | 137/79 |
| 4,081,173 | 3/1978 | McCabe | 251/308 |
| 4,113,230 | 9/1978 | McCabe | 251/305 |
| 4,113,232 | 9/1978 | McCabe | 251/305 |
| 4,114,646 | 9/1978 | McCabe | 137/601 |
| 4,183,129 | 1/1980 | McCabe | 29/157 R |
| 4,185,657 | 1/1980 | McCabe | 137/601 |
| 4,185,658 | 1/1980 | McCabe | 137/601 |
| 4,219,185 | 8/1980 | McCabe | 251/308 |
| 4,256,143 | 3/1981 | Magill | 137/601 |

*Primary Examiner*—Robert G. Nilson

*Attorney, Agent, or Firm*—Benasutti Associates, Ltd.

[57] ABSTRACT

A damper for adjusting and balancing the air flow rates in air conditioning and similar large gas flow systems is disclosed which comprises at least one pivotable blade located in a frame which is capable of being fitted onto or into one of the ducts in said system so that said blade pivots between fully open and closed positions. Associated with the blade is an adjustment device adapted to permit the blade to be easily rotated and locked in an intermediate position whereby said balance is achieved.

7 Claims, 4 Drawing Figures

BALANCING DAMPER WITH QUICK SET ADJUSTMENT BRACKET

BACKGROUND OF THE INVENTION

This invention relates to balancing dampers and more particularly to quick set bracket means adapted to adjust said dampers to intermediate operational positions between fully opened and fully closed.

A balancing damper is an adjunct to the ductwork of an air conditioning or other high volume air handling system which is installed for the purpose of adjusting the flow therethrough into the various areas where the airflow is to be discharged. One type of damper which is utilized for this purpose comprises a plurality of blades which are controlled by a single operator so that they can move from fully opened to fully closed in unison. Furthermore, these are usually adapted so that where some intermediate level of control is necessary they can be stopped and held somewhere in-between to achieve this control.

Many types of multiblade dampers such as those illustrated in U.S. Pat. Nos. 3,009,473, 3,592,240, and 3,771,559 are used. These types of dampers operate in an opposite blade fashion to create one or more substantially triangularly shaped openings within the damper structure. These dampers all suffer from the problem that as the air passes through them, a significant amount of turbulence is created in the flowing air which causes an excessively large impedance to air flow in the system. This means that in order to achieve the volumetric efficiency required for most large air conditioning systems, larger capacity fans must be used to operate the system.

In still other types of air damper systems as shown in my U.S. Pat. No. 4,113,232, the blades do not open in an opposed manner, but act to establish a plurality of parallel channels with laminar flow therein. This creates a minimum impedance flow condition so that for equivalent capacities a smaller fan can be used as compared to that required for opposed blade types of damper systems.

Either type of damper serves the purpose of adjusting the flow into a particular room or working area to achieve proper working temperatures therein. This is especially important with current mandated energy conservation requirements. However, in most devices of this type, quick adjustment of the damper to achieve the necessary flow levels is often quite difficult and furthermore, once set, many cannot be easily locked into this position. The subject invention is designed to overcome this problem.

SUMMARY OF THE INVENTION

The present invention generally comprises a single blade damper or a multiblade damper having a single operator which acts to open and close all of the blades as a unit. This type of damper is widely used for a variety of air control purposes. In the particular mode of application illustrated herein, the damper operator has attached to its side a quick set adjustment means, which allows the damper blades to be easily rotated to a particular angular configuration and then locked in place. In the preferred configuration, the adjustment means comprises a flap having an arcuate slot placed therein, said flap being attached to one of the damper blades or operator blades. Positioned through this slot and attached to the frame of the damper is a locking device, such as a sheet metal screw which when loosened allows the damper blades to be rotated. For multiblade dampers, this adjustment means is usually attached to just one of the damper blades, since when one is rotated the operator causes all to be rotated. When the proper flow level is reached, as determined either by air velocity or temperature measurements made during the time of adjustment, the locking means is tightened down and the damper blade or blades are firmly locked into position. This type of device allows a maintenance operator to achieve the requisite level of control with a minimum amount of tools and in a minimum of time.

Accordingly, the primary object of the present invention is to provide an improved air damper for air control purposes.

Another object of the present invention is the provision of a damper which establishes laminar flow conditions in the duct systems in which it is used.

Still another object of the present invention is the provision of a laminar flow damper system which can be quickly and easily adjusted.

Further objects of the present invention will become apparent from the following detailed description taken in conjunction with the attached drawings.

DETAILED DESCRIPTION OF THE PREFERRED EMBODIMENT

Figure 1:
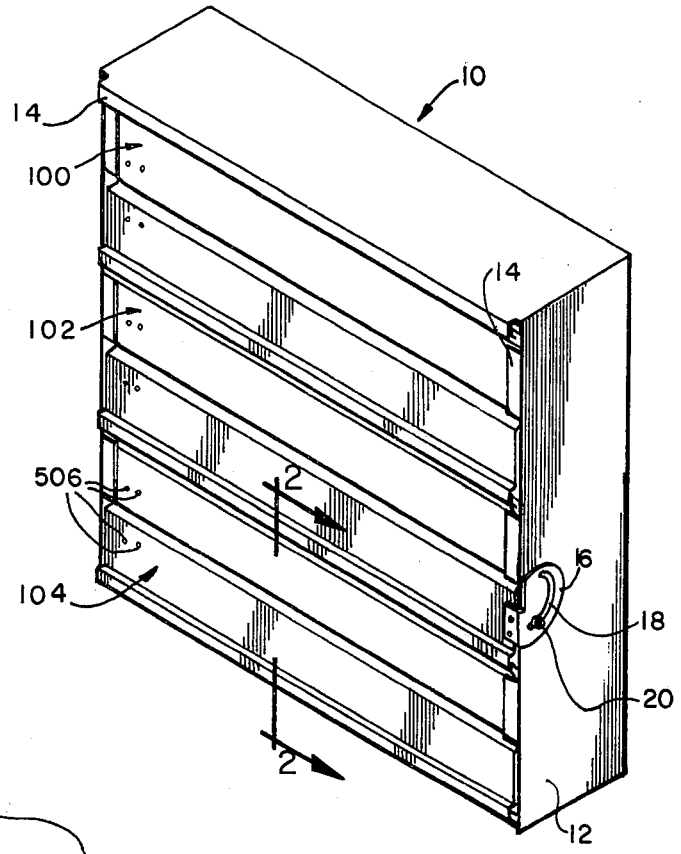
FIG. 1 is an isometric view of a multibladed parallel laminar flow air balancing damper of the present invention.

While specific forms of the invention have been selected for illustration in the drawings, and the following description is drawn in specific terms for the purpose of describing these forms of the invention, this description is not intended to limit the scope of the invention which is defined in the appended claims.

Figure 3:
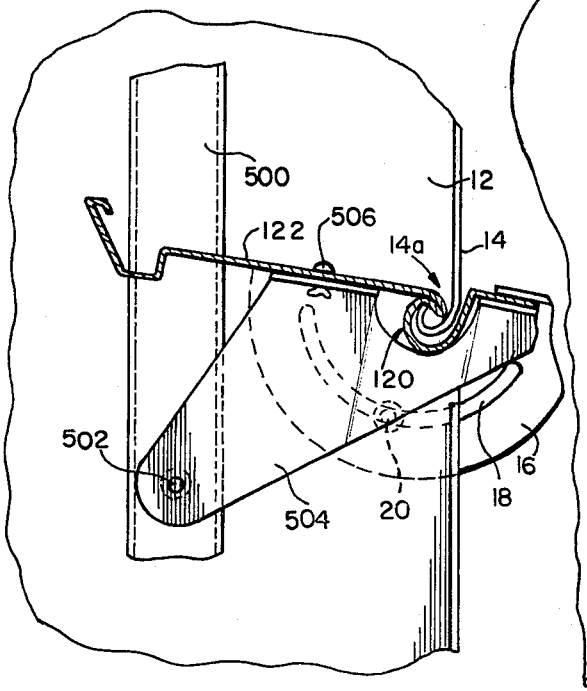
FIG. 3 is a fragmentary view of that portion of the damper illustrated in FIG. 2 showing the linkage rod blade engaging bracket and blade in the fully opened position.
Figure 2:
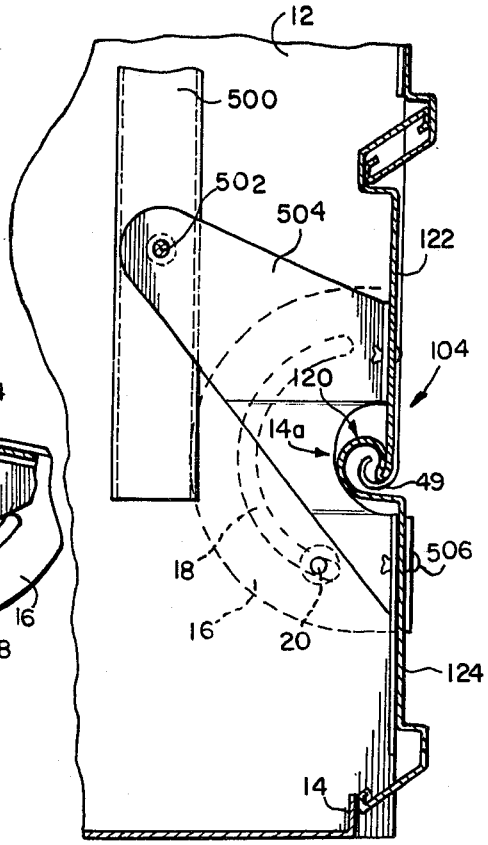
FIG. 2 is a fragmentary cross section of a portion of the damper illustrated in FIG. 1 taken as indicated by the lines and arrows 2—2 in FIG. 1.

Referring now to the figures, FIG. 1 illustrates a typical multibladed laminar flow damper 10, such as illustrated in my U.S. Pat. No. 4,185,658 entitled "Rotating Blade Fire Damper" which is fully incorporated herein by reference. As shown, this comprises a box-like frame 12 which is normally intended to be attached at the end portion of a duct (not shown) leading into a room. Associated with the frame is a plurality of blades mounted thereon designated generally 100, 102, and 104, and four inwardly depending flanges 14, one each on the top, bottom and left and right sides of frame 12 and which act to sealingly engage the damper blades when they are in the fully closed position. Referring now to FIGS. 2 and 3, each of the blades comprises a hinge portion designated generally 120, to which two blade faces 122 and 124 which are slightly offset with respect to each other are attached (see FIG. 2). The hinge portion 120 is adapted to matingly engage folds **14*a* in flange 14** to form a pivot or hinge for the blade.

In multibladed dampers each blade further comprises a coupling plate 504, which is rotatably connected at pivot point 502 to operator bar 500 and attached to the blade by screws or rivets 506. By connecting all of the blades in this fashion they can be opened and closed as a unit. Fuller details of the structure of this particular damper are contained in my U.S. Pat. No. 4,114,646.

Figure 4:
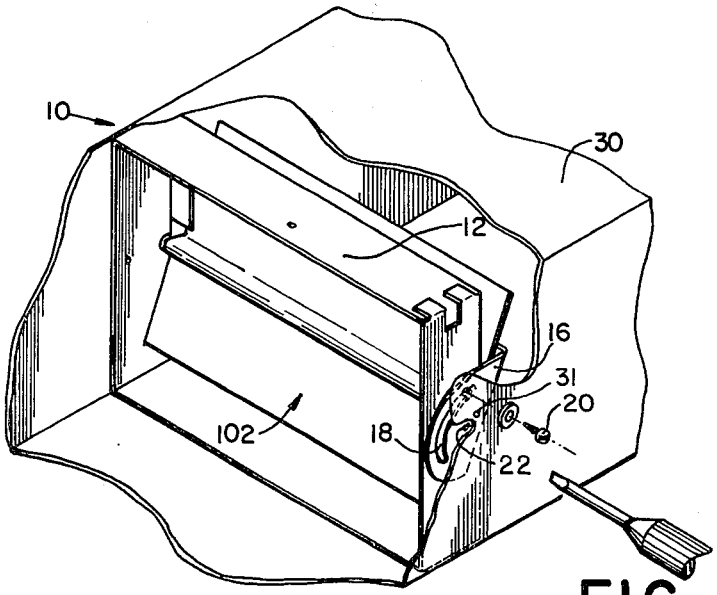
FIG. 4 is a perspective view of a single bladed laminar flow damper with a second embodiment of the damper setting mechanism.

Attached to the outside of frame 12 is damper adjustment means 16. As shown, this is a plate mounted on the outer side of frame 12 and is attached to one of the blades of the damper, usually to the hinge portion 120 or to the blade face. As shown, adjustment means 16 is semi-circular in shape and has an arcuate slot 18 cut therein. Threadingly mounted into frame 12 is locking screw 20, which fits through slot 18, and is adapted so that when it is screwed tight against damper adjustment means 16 the blades associated with it are firmly clamped. However, when loosened the damper adjustment means and its associated blades can be freely rotated to assume whatever position is necessary to balance the flow rate of the system. Depending on the access that the operator has to the damper, this rotation may be accomplished simply by grasping one of the blades and turning it, thus turning all of the blades at the same time.

Where this is not possible, an alternate arrangement, as shown in FIG. 4, can be used. Here, damper adjustment means 16 further includes screwdriver adjustment slot 22 attached to hinge 120 which, when engaged by a turning means such as a screwdriver, acts to turn the damper mechanism and adjust it as herein above described. Further, as shown in FIG. 4, which illustrates a single bladed laminar flow system having the damper adjustment means located inside the duct 30, the slot is aligned with and indicates the angular position of the blade to which it is attached so that it can be precisely set by merely observing its angular relationship to a fixed reference mark 31 on the outside of the duct wall. Thus adjustment is relatively simple and balancing the air flow rate of the system is straightforward.

It will be understood that various changes in the details, materials and arrangement of parts which have been herein described and illustrated in order to explain the nature of this invention may be made by those skilled in the art within the principles and scope of the invention as expressed in the following claims.

What is claimed is:

1. In a damper adapted for use in a duct and having a frame and at least one pivotally mounted blade movable between an open and a closed position with respect to said frame, an improved adjustment means comprising:

(a) an adjustment plate attached to said blade and including portions which extend along portions of said frame and an arcuate slot which defines the angle through which said blade can pivot; and (b) means for locking said blade in a selected position, extending through portions of said duct and the arcuate slot of said adjustment plate and into threaded engagement with said frame;

(c) wherein said damper and said adjustment plate are capable of being contained within said duct;

so that tightening said locking means clamps said adjustment plate between said frame and said duct, thereby restraining said blade, and so that loosening said locking means permits movement of said blade.

2. The damper of claim 1 wherein said adjustment plate extends laterally along and between said frame and a duct in which said damper is positioned.

3. The damper of claim 1 wherein said adjustment means further comprises an adjustment slot adapted for engagement by a turning means and operatively associated with said blade, wherein said adjustment slot is in alignment with a hole extending through said duct.

4. The damper of claim 3 wherein said adjustment slot forms a means for indicating the angular position of said blade within said damper.

5. The damper of claim 1 wherein said blade includes means for pivotally mounting said blade within said damper comprising a stamped hinge element forming part of said blade and a flange associated with said frame for engaging said stamped hinge element.

6. The damper of claim 1 wherein a plurality of blades are associated with the adjustment means so that said plurality of blades are capable of being opened and closed as a unit.

7. The damper of claim 1 wherein said adjustment means further comprises an adjustment slot adapted for engagement by a turning means and operatively associated with said blade, wherein said adjustment slot is adapted for alignment with a hole extending through said duct.

* * * * *